United States Patent [19]

Henry

[11] Patent Number: 4,700,036

[45] Date of Patent: Oct. 13, 1987

[54] INDUCTION HEATING DEVICE WITH IMPROVED LOCKING MECHANISM FOR SLIDABLE INDUCTORS

[75] Inventor: Michael W. Henry, Cleveland, Ohio

[73] Assignee: Tocco, Inc., Boaz, Ala.

[21] Appl. No.: 747,941

[22] Filed: Jun. 24, 1985

[51] Int. Cl.[4] ..... H05B 5/00

[52] U.S. Cl. ..... 219/10.57; 219/10.75; 219/10.79; 219/10.73; 266/129

[58] Field of Search ..... 219/10.43, 10.57, 10.77, 219/10.79, 10.69; 266/129, 92, 90

[56] References Cited

U.S. PATENT DOCUMENTS

| | | | |
|---|---|---|---|
| Re. 29,046 | 11/1976 | DelPuggio | 219/10.43 |
| 3,696,224 | 10/1972 | Lewis | 219/10.57 |
| 3,970,813 | 7/1976 | Day | 219/10.79 |
| 4,535,212 | 8/1985 | Sheetz et al. | 219/10.57 |
| 4,538,041 | 8/1985 | Budzinski | 219/10.57 |
| 4,542,272 | 9/1985 | Hubbard | 219/10.57 |

*Primary Examiner*—M. H. Paschall
*Attorney, Agent, or Firm*—Body, Vickers & Daniels

[57] ABSTRACT

A disengagable locking arrangement for holding an inductor assembly for heating a valve seat, which assembly is reciprocally movable along a path through a support structure. The support structure includes a "P" shaped clamp disposed within a cavity in the support structure. The clamp has arcuate arm portions substantially surrounding the movable inductor assembly with surfaces for frictional engagement therewith. The clamp also has base arm portions laterally offset from the movable assembly through which a spindle generally transverse to the path of the member extends. A mechanism associated with the spindle is provided for drawing the arcuate arm portions toward each other when the spindle is rotated about its axis in a predetermined direction to effect locking engagement between the clamp and the assembly.

11 Claims, 5 Drawing Figures

INDUCTION HEATING DEVICE WITH IMPROVED LOCKING MECHANISM FOR SLIDABLE INDUCTORS

BACKGROUND OF THE DISCLOSURE

This invention relates to the art of induction heating of valve seats preparatory to quench hardening and, more particularly, to a disengagable apparatus for locking a movable inductor assembly in a stationary position with respect to a movable support structure.

BACKGROUND OF THE INVENTION

For the last several years, it has become common practice to harden valve seats of internal combustion engines to compensate for the lack of lead and phosphorus in most gasolines. Most, if not all, machines for this purpose manufactured in the United States have the apparatus and method shown in assignee's prior U.S. Pat. No. Re. 29,046 which is incorporated herein by reference. The aforementioned patent relates to an apparatus having a plurality of inductor assemblies or devices aligned with respect to the conical valve seats of a workpiece. Each inductor assembly includes a single turn loop or inductor having a shape generally matching the valve seat surface. A support frame reciprocally movable toward the workpiece holds the inductor devices generally aligned with the valve seats. Each inductor device is reciprocally movable within a housing and biased toward the valve seat. As the support frame moves toward the workpiece the biasing arrangement allows the inductor devices to stop when the loop or inductor contacts the valve seat as the support frame continues forward movement. After all inductors are in their proper position with respect to the individual valve seats, the inductor devices are locked in a fixed position with respect to the housing and the support frame. In this manner, all variations of spacing of the valve seats and their respective inductors are compensated for by the movements of the inductor devices. After the locking has been effected, the support frame is backed-off a predetermined distance to provide a gap between the valve seat and the inductor. After this back-off movement all the inductors are in their proper heating position relative to the respective valve seats. The inductors are then energized and the valve seats are inductively heated for subsequent quenching.

With respect to such an apparatus, it is important that the inductors are securely fixed to the support frame to ensure proper spacing from the valve seat when the support frame is withdrawn from the workpiece. The locking mechanism disclosed in the above mentioned patent, and known heretofore, includes a generally C-shaped clamp ring which surrounds the sleeve portion of each inductor device. Locking action, of each ring is provided by a cylinder associated therewith.

One problem with such an arrangement is that each inductor device is clamped individually by an independently operating actuating device, i.e., the separate operation of each cylinder. In this respect, there is no simultaneous, positive locking of each inductor device and the actual position of the ring is not known. Because each clamp ring is individually operated, the clamping pressure exerted on the sleeve, may vary depending on the condition or pressure of each cylinder. Insufficient pressure in a given cylinder may reduce the effective closing and holding capability of a clamp ring to the point where the biasing means may produce sliding of the sleeve within the clamp ring. Likewise, excessive pressure on the cylinder may produce deformations or surface imperfections in the sleeve which restricts easy movement of the sleeve within the support housing.

Another problem with the prior mechanisms is that there is no positive mechanical arrangement to ensure unclamping of the sleeve. In the prior apparatus, the resiliency of the clamp ring itself is intended to open the ring to release the sleeve for reciprocable movement. However, as will be appreciated, the rapid and cyclic opening and closing of the cylinder actuated ring tends to fatigue the ring to an extent the resiliency of the ring gradually deteriorates. In this respect, as the resiliency of the ring diminishes, less clearance exists between the ring and the sleeve which hinders the free and easy movement of the sleeve therein, and may even cause the sleeve to bind within the clamp ring.

An additional problem associated with the cylinder actuated clamping ring disclosed in assignee's prior patent is that each cylinder includes at least two pneumatic or hydraulic lines or hoses which are cumbersome and inconvenient to work within the vicinity of the inductor device. Further, hydraulic fittings, hoses or cylinders may rupture or leak which, among other things, may effect the sliding and clamping movement of the inductor device sleeve should hydraulic fluid or oil seep into the housing.

These and other problems are overcome by the present invention which provides a disengagable locking arrangement for a valve seat induction heating apparatus which mechanically actuates the clamping means on the inductor assemblies simultaneously and gradually, at a controlled rate, clamps the inductor devices relative to the support structure.

BRIEF SUMMARY OF THE INVENTION

According to the present invention there is provided a disengagable locking arrangement for an apparatus for inductively heating valve seats, which apparatus includes a selectively movable support structure adapted to be moved along an axis between an extended heating position and a retracted heating position; and, an inductor assembly having a carrier, an inductor having a shape matching the valve seat mounted on the carrier, and means for supporting the inductor assembly on the movable support frame wherein the inductor assembly is reciprocally movable along the axis. The locking arrangement includes clamp means disposed on the support structure, which clamp means include arm portions which substantially surround an inductor assembly and have surfaces for frictional engagement therewith. Spindle means, having an axis generally transverse to and offset from the axis of the inductor assemblies, extend through regions of the arm portions. Means are provided for rotating the spindle means about its axis wherein means associated therewith translates rotational movement of the spindle means to linear motion of an arm portion such that rotation of the spindle means in one direction effects movement of the arm regions gradually toward each other such that the surfaces on the arm portions frictionally engage and hold the inductor assembly stationary with respect to the structure.

Further in accordance with the present invention, there is provided a mechanical arrangement for simultaneously locking in a fixed position a plurality of inductor assemblies. The arrangement includes a clamping means associated with each inductor assembly having first and second arm portions transverse to and on opposite sides of the inductor assembly, which arm portions have surfaces for frictional engagement with the assembly. Regions extend from the arm portions to one side of the inductor assemblies. Spindle means extend through the regions of the arm portions and along an axis generally perpendicular to, and offset from, the axis of the assemblies. Translating means associated with the spindle means effects gradual movement of the arm portions toward each other for frictional engagement with the inductor assemblies when the spindle means is rotated about its axis in a predetermined direction.

Further in accordance with the present invention, there is provided a generally P-shaped clamp arrangement including first and second arm portions having opposed surfaces for clamping an elongated cylindrical member therebetween. A spindle extends through regions of the arm portions which are offset from the member to be clamped. A sleeve is associated with the spindle and one of the arm portions such that rotation of the spindle imparts linear motion to such arm portion. Rotation of the spindle in one direction gradually draws the arm portions toward each other to effect clamping of the member by the clamping surfaces.

An object of the present invention is to provide a disengagable locking mechanism for fixedly securing a movable inductor assembly stationary with respect to a support structure.

Another object of the present invention is to provide a locking mechanism as described above wherein the inductor assembly is reciprocably movable along a predetermined path and the position at which the assembly is to be secured may vary along such path.

A further object of the present invention is to provide a locking mechanism as described above wherein the locking and unlocking of the movable inductor assembly is mechanically actuated, and the locking mechanism engages the movable member gradually at a predetermined rate.

A still further object of the present invention is to provide an arrangement for simultaneously locking a plurality of movable assemblies in a fixed position with respect to a support structure.

A still further object of the present invention is to provide a locking arrangement as defined above wherein the individual mechanism for securing each assembly to the support structure includes a clamp having clamping arm portions actuated by the movement of a rotating spindle therethrough.

A still further object of the present invention is to provide a locking mechanism as defined above wherein the locking arrangement does not require hydraulic or pneumatic devices.

Further objects and advantages of the invention will become readily apparent to those skilled in the art upon a reading and understanding of the following specification.

BRIEF DESCRIPTION OF THE DRAWINGS

The invention may take physical form in certain parts and arrangement of parts, a preferred embodiment of which will be described in detail in the following specification and illustrated in the accompanying drawings which form a part hereof and wherein.

DETAILED DESCRIPTION OF PREFERRED EMBODIMENTS

Figure 1:
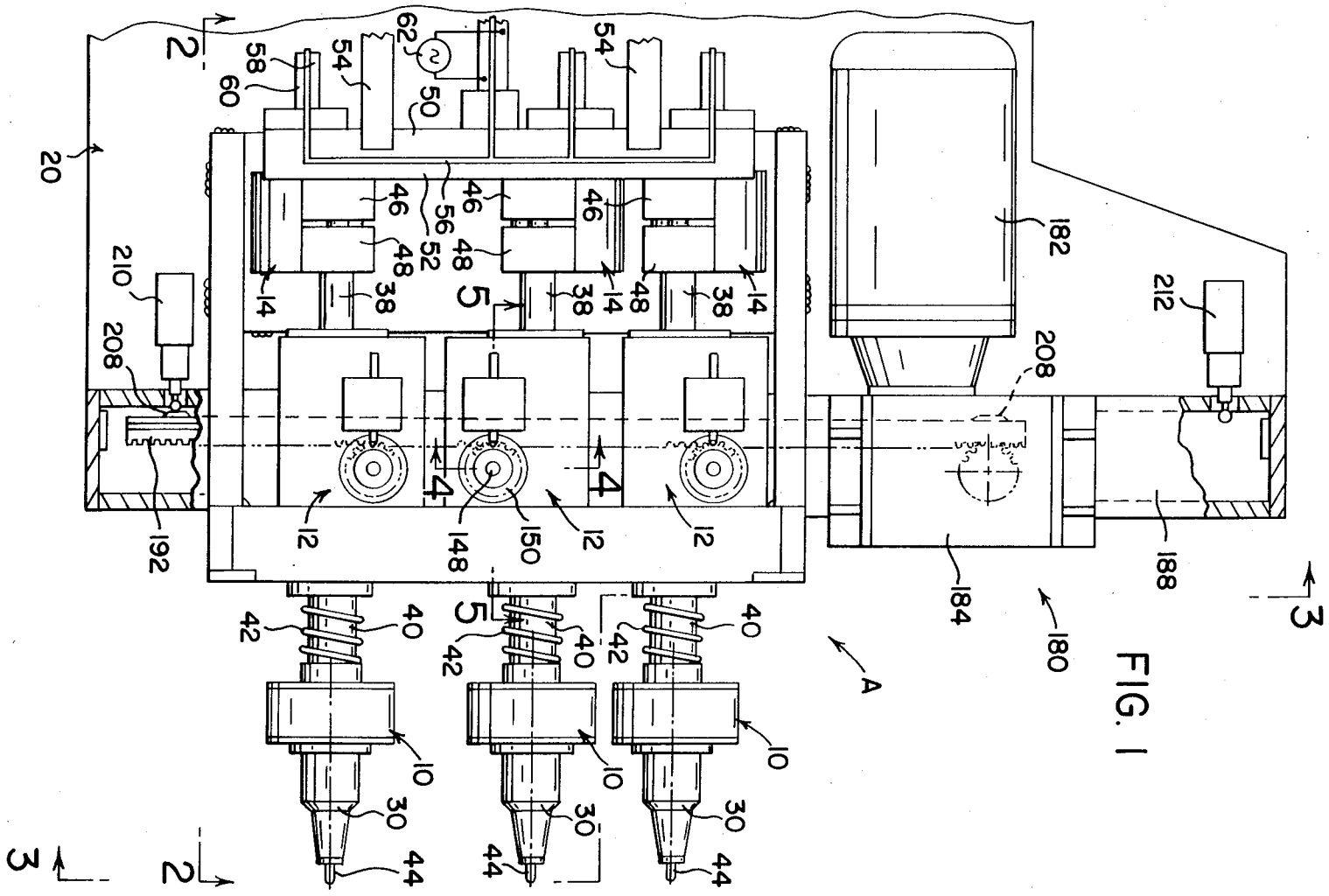
FIG. 1 a top plan view, partially sectioned, illustrating an apparatus for inductively heating valve seats incorporating the concept of the present invention.
Figure 2:
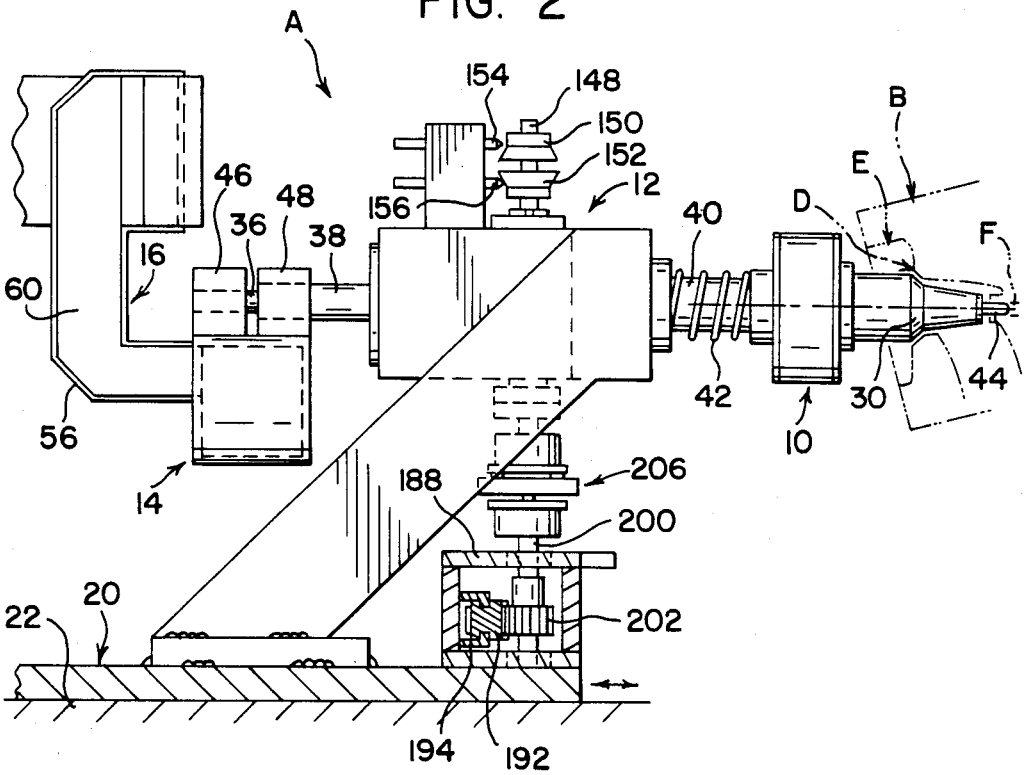
FIG. 2 a side elevational view taken generally along line 2—2 of FIG. 1.
Figure 3:
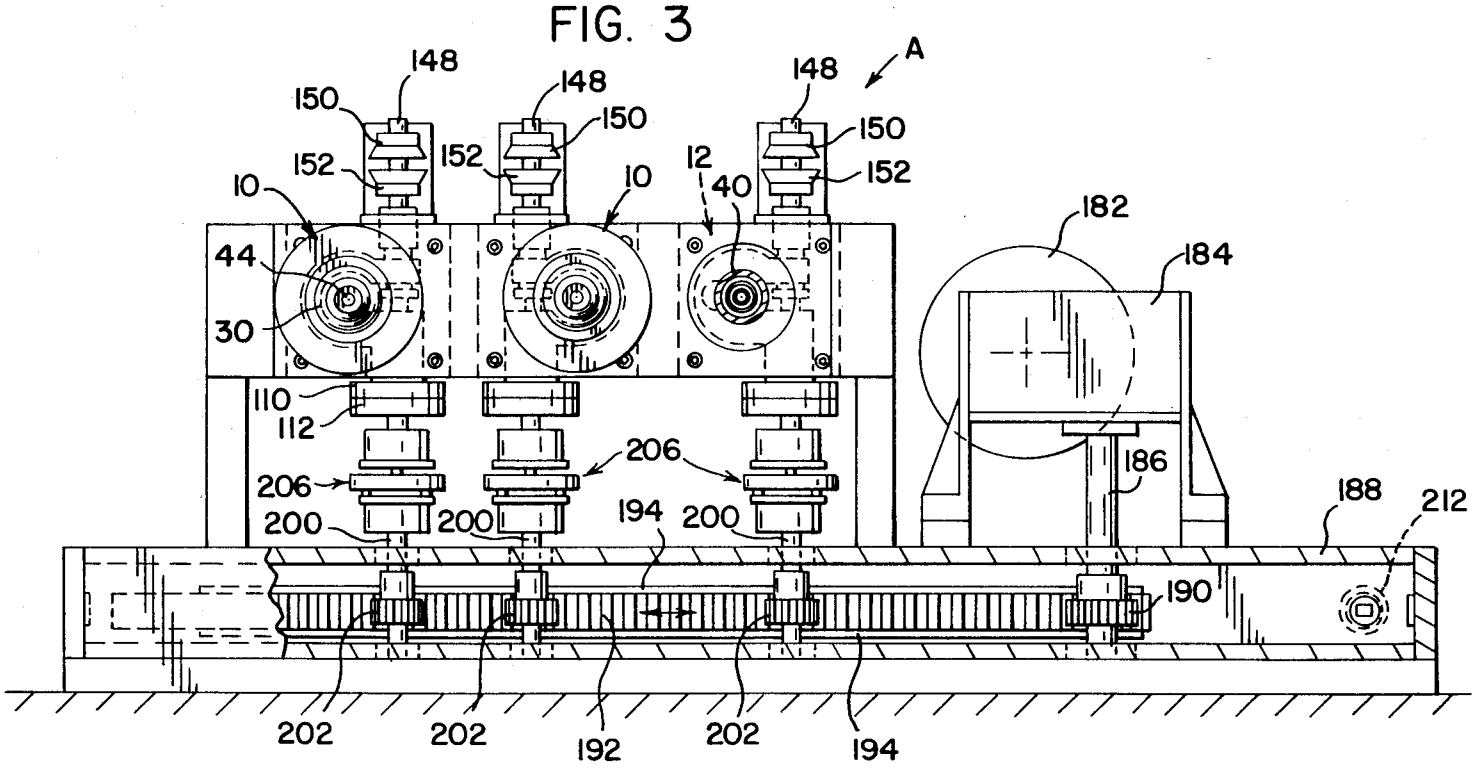
FIG. 3 a front elevational view partially in section, taken generally along line 3—3 of FIG. 1.

Referring now to the drawings wherein the showings are for the purpose of illustrating a preferred embodiment of the invention only and not for the purpose of limiting same, FIGS. 1-3 show an induction heating device A and an engine head B held stationary with respect thereto. The engine head includes a plurality of spaced valve seats D generally lying in a common plane and within recess exhaust ports E. Concentric with the conical valve seats are a plurality of bores F which are adapted to receive the valve stems of a conventional poppet valve. Apparatus A includes an inductor assembly or device 10, an inductor support and locking device 12 (best shown in FIGS. 4 and 5), an inductor transformer 14, a power input 16, a support frame 20 for carrying the above mentioned mechanisms, and a platform 22 on which mounting support frame 20 is reciprocably movable toward and away from workpiece B.

Referring now more particularly to inductor assembly 10, such device generally includes a single turn loop or inductor 30 connected by leads (not shown) to a hollow tube 36 in a hollow sleeve 38, which are insulated from each other. Tube 36 and sleeve 38 are the basic connector leads for loop 30. Leads 36 and 38 are mounted in sleeve 40, which in turn is mounted for reciprocable movement in support and locking device 12. Inductor assembly 10 is biased toward workpiece B by spring 42 which surrounds sleeve 40. At one end of assembly 10 there is provided an outwardly extending tip 44 having a shaft portion that is dimensioned to coact with bore F of engine head B. Leads 36 and 38 are connected to transformer 14 by mounting blocks 46, 48, respectively. Insulated bus bars 50, 52 are supported by an appropriate support structure 54 and separated by an insulation 56. Output leads 58 and 60 connect bus bars 50, 52 to transformer 14. The apparatus heretofore described in and of itself forms no part of the present invention and is disclosed in assignee's prior U.S. Pat. No. Re. 29,064 which is incorporated herein by reference.

Figure 4:
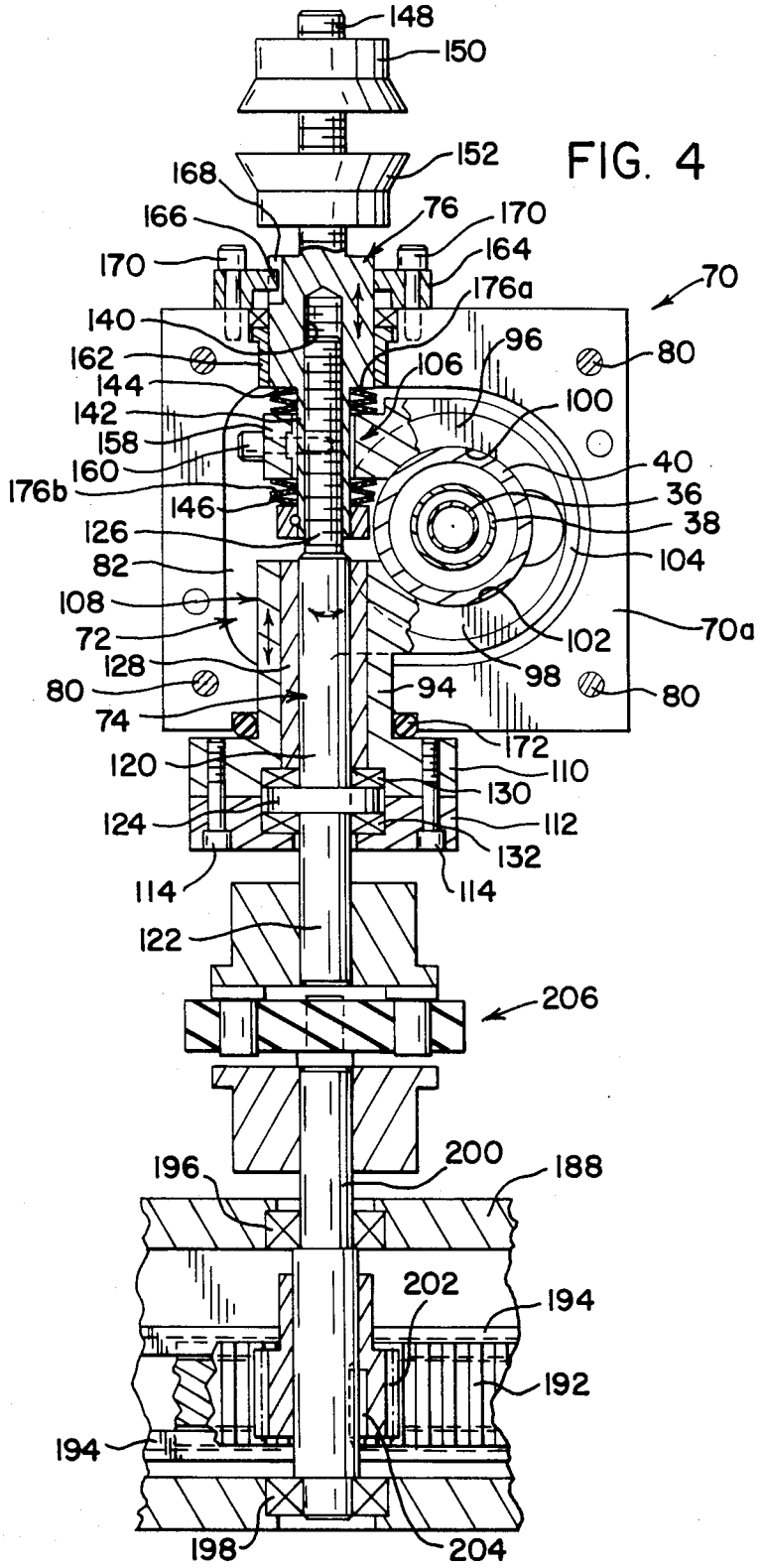
FIG. 4 an enlarged partial cross-sectional view taken generally along line 4—4 of FIG. 1; and, FIG. 5 is an enlarged cross-sectional view taken generally along line 5—5 of FIG. 1.
Figure 5:
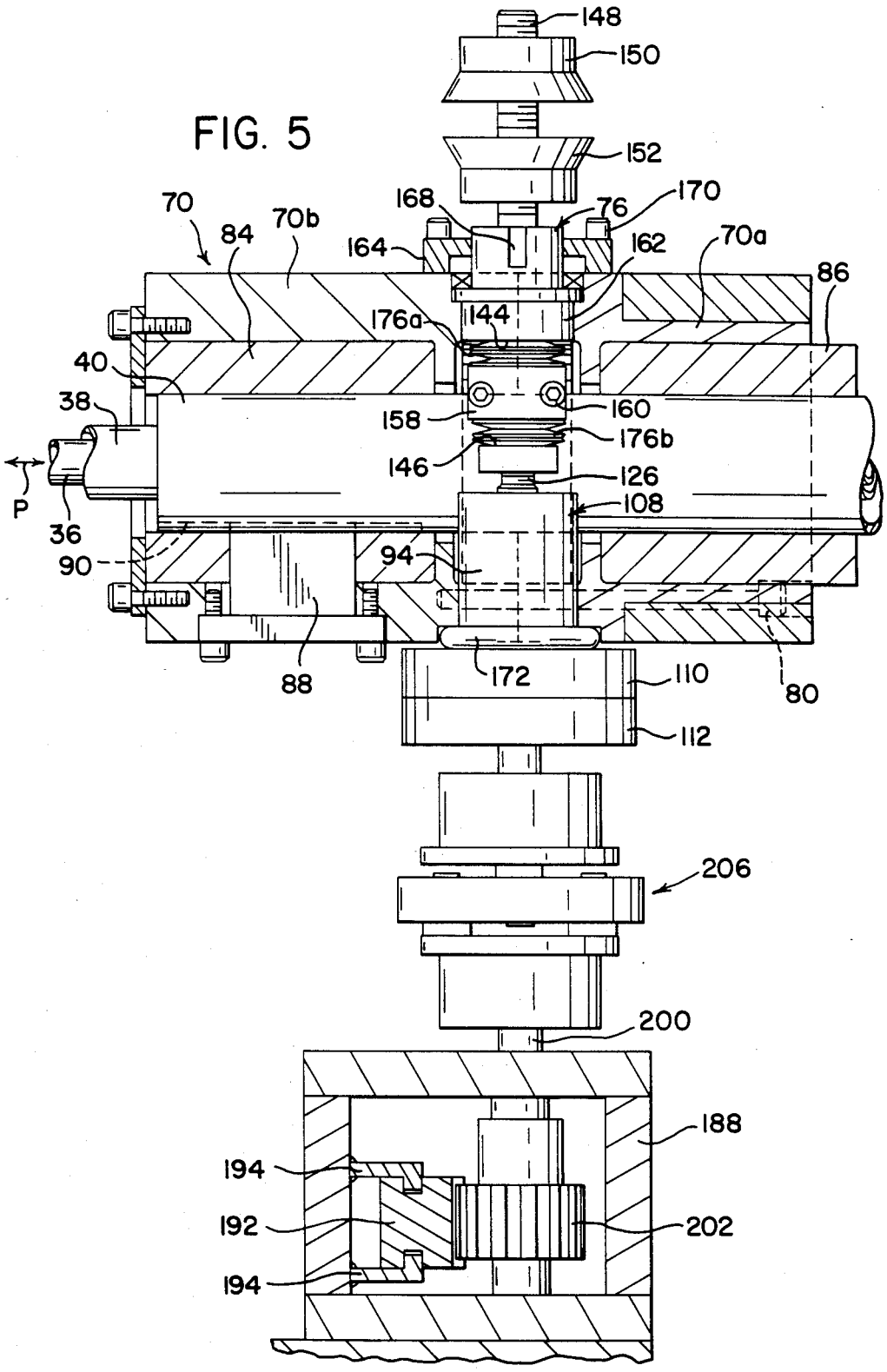

Referring now to FIGS. 4 and 5, the inductor support and locking device 12 provides for reciprocable movement of sleeve 40 of assembly 10, and for locking sleeve 40 at a reciprocable position determined by the backward movement of assembly 10 as it contacts the engine head during forward movement of the support frame 20. According to the present invention, broadly stated, inductor support and locking device 12 is comprised of a housing 70, a clamp 72, a clamp spindle 74 and a sleeve actuator 76.

Housing 70 is comprised of right and left hand sections 70*a*, 70*b* held together by bolts 80. A void or chamber 82 is provided in housing 70 through which sleeve 40 of inductor assembly 10 passes and is reciprocably movable along a path P. Within housing 70 two axially aligned bearings or bushings 84, 86 are provided to support sleeve 40. A key 88 in bushing 84 coacting with a keyway 90 in sleeve 40 prevents rotation of sleeve 40 about its axis while at the same time allowing movement along path P.

Clamp 72, which locks sleeve 40 and thus assembly 10 stationary relative to housing 70, has generally a P-shaped configuration as seen in FIG. 4. Clamp 72 includes a body portion 94 and arm portions 96, 98 which are situated on opposite sides of sleeve 40. Arm portions 96, 98 include opposed surfaces 100, 102 for engagement with sleeve 40, and are connected at one end by a bridging or connecting portion 104 of reduced cross-section. In a manner as is conventionally known, and as shown in FIG. 4, the cross-section or bridging portion 104 may be reduced by removing a portion of the material forming the clamp. The reduced cross-sectional area of bridging portion 104 facilitates bending or flexing of the arm portions thereat. Arm portions 96, 98 include regions 106, 108 which are laterally offset from sleeve 40 and which are generally aligned with body portion 94. Clamp 72 includes a base portion 110 having retainer 112 secured thereto by screws 114. Axial openings extending through body portion 94 and regions 106, 108 are provided in clamp 72 for spindle 74.

Spindle 74 includes a cylindrical body portion formed by two cylindrical sections 120, 122 of equal diameter, a large diameter cylindrical portion 124 therebetween, and a threaded portion 126 of reduced diameter. A bushing 128 is provided within body portion 94 to axially support spindle 74 therein. Thrust bearings 130, 132 in recesses in base portion 110 and retainer 112 are provided on opposite sides of spindle portion 124 to prevent axial movement of spindle 74 relative to clamp 72. Spindle 74 when assembled within clamp 72 extends along an axis perpendicular to and offset from the axis of sleeve 40.

Actuator sleeve 76 is provided with internally threaded portion 140 for matching engagement with threaded portion 126 of spindle 74. Sleeve 76 is of cylindrical cross-section and includes a cylindrical mid-section 142 of reduced cross-section thereby defining annular shoulder surfaces 144, 146. A threaded rod 148 of reduced cross-section extends from the upperend of sleeve 76 above housing 70. Actuators 150, 152 to engage switches 154, 156 are provided to indicate the relative position of the locking device. To faciliate assembly of actuator sleeve 76, spindle 74 and clamp 72, region 106 of arm portion 96 includes a separate retainer plate or bar 158 secured to arm portion 106 by screws 160. As best seen in FIG. 4, region 106 of arm portion 96 is assembled around cylindrical mid-portion 142 of sleeve 76. Bellville springs **176*a*, 176*b* are located on opposite sides of region 106 and between annular shoulder surfaces 144, 146, respectively. According to the preferred embodiment, three bellville springs are provided on each side of region 106 of arm portion 96**.

The assembly of clamp 72, spindle 74, and actuator 76 is situated within void or chamber 82 of housing 70 by means of openings extending through top and bottom thereof. A bushing 162 is provided between housing 70 and actuator sleeve 76 to facilitate movement thereof along threaded portion 126 of spindle 74. An actuator retainer 164 is provided on housing 70 and includes a tab 166 extending into an axially aligned slot 168 in actuator sleeve 76 to prevent rotation of sleeve 76 relative to housing 70. Retainer 164 is secured to housing 70 by means of screws 170. Body portion 94 of clamp 72 fits loosely within the bottom opening in housing 70, and resilient gasket means 172 in the form of an O-ring, is provided between clamp base portion 110 and the bottom surface of housing 70. In this respect, the components forming the clamping arrangement may be easily assembled and adjusted relative to each other and relative to sleeve 40 in that clamp 72 is movable vertically within limits within chamber 82 of housing 70.

With respect to support arm locking device 12 as heretofore described, because sleeve actuator 76 is restrained from rotational movement by tab 166 on retainer 164, rotational movement of spindle 74 about its axis will be translated to linear movement of sleeve actuator 76 along the axis of the spindle. In the orientation shown, downward movement of the actuator sleeve along threaded portion 126 of spindle 74 will compress Bellville springs **176*a* against region 106 of clamp arm portion 96. Arm portion 96 will thus be biased or urged toward the lower arm portion 98 such that arcuate surfaces 100, 102 are brought into frictional engagement with sleeve 40 thereby locking the sleeve stationary with respect to housing 70. In a similar manner, reversing rotation of spindle 74 will cause actuator sleeve 76 to move upward along spindle portion 126 wherein Bellville springs 176*b* are compressed against the bottom of region 106 of arm portion 96 and urge arm portion 96 away from lower arm portion 98 thereby releasing sleeve member 40 from locked engagement with housing 70. Accordingly, positive and mechanically effected disengagement is provided to release the sleeve. Arm portion 96 is thus movable relative to arm portion 98 which is generally stationary with respect to clamp body 94. Likewise, arm portion 96 is generally free to float within chamber 82, and does not engage the inner walls of housing 70**.

Referring now to FIGS. 1–3, the drawing shows a typical three inductor machine wherein each inductor assembly 10 is provided with a support and locking device 12 as shown in FIGS. 4 and 5 and as heretofore described. To simultaneously actuate each support and locking device 12 there is provided a mechanical actuating arrangement 180. Actuator arrangement 180 is comprised of a reversible motor 182 capable of rotating in alternate directions. Motor 182 is connected to a conventional geared speed reducer 184 having an output shaft 186 which extends into a rectangular, elongated housing 188 and is supported therein by aligned bearings in a manner as is conventionally known. A pinion gear 190 is provided on shaft 186 within housing 188 to impart alternating linear motion to a gear rack 192. Rack 192 is supported by guide members 194 as best seen in FIG. 5. Supported within housing 188 by means of aligned bearings 196, 198 are spindle drive shafts 200. Each drive shaft 200 is below and axially aligned with a spindle 74 from support and locking device 12. Pinion gears 202, which are locked to shaft 200 by key arrangements 204, are arranged to engage gear rack 192 and to translate the linear motion of rack 192 to rotational motion of shaft 200. Shaft 200 is coupled to spindle 74 by conventional coupling means 206 to communicate rotation of shaft 200 to spindle 74. Switch actuators 208 are located near the distal ends of rack 192 for contact with switches 210, 212 which are used to indicate and limit the position of gear rack 192.

The general operation of the apparatus for inductively heating valve seats has been generally described above. With respect to the present invention, when all the inductor assemblies 10 are seated against valve seat D of workpiece B, forward movement of support frame 20 is stopped. In this repsect, adjustable switch means (not shown) are used to indicate the position of support frame 20 with respect to workpiece B and to cease the forward movement thereof. The switch means likewise actuate motor 182 to impart linear motion, via pinion gear 190, to rack gear 192. The linear motion of rack 192 simultaneously rotates pinion gears 202 on spindle drive shafts 200. Rotation of drive shafts 200 is communicated to the respective spindles 76 of each support and locking device 12. The rotation of spindle 74 imparts linear motion to actuator sleeve 76 in a downward direction which in turn urges or biases arm portion 96 toward arm portion 98, thereby exerting arcuate surfaces 100, 102 into engagement with sleeve 40 and thus locking sleeve 40 with respect to housing 70. Importantly with respect to the present invention, equal clamping pressure can be applied around the diameter of sleeve 40 in that clamp 72, and more particularly arm portion 96, floats inside clamp housing 70. In addition, the Bellville springs between the actuator sleeves and the movable arm portion 96 reduces pressure variations between the respective clamps and promotes a more equal pressure distribution on all inductor sleeves 40. Accordingly, there is provided a novel, disengagable clamping device and arrangement which gradually, simultaneously and uniformly clamps a plurality of inductor devices in a locked position relative to the support housing for more uniform and positive locking thereof.

The invention has been described with reference to a preferred embodiment. Obviously modifications and alterations will occur to others upon a reading and understanding of the specification. It is intended to include all such modifications and alterations insofar as they come within the scope of the appended claims or the equivalence thereof.

Having thus described the invention, the following is claimed:

1. In an apparatus for inductively heating a generally conical valve seat formed concentrically around a central bore in an engine component, said apparatus including a selectively movable support structure adapted to be moved along a longitudinal axis between an extended heating position and a retracted loading position; and an inductor assembly including an inductor having a shape generally matching said valve seat, an aligning nose member extending from said carrier parallel to said axis and generally concentric with said inductor, and a carrier containing said inductor, and means for mounting said inductor assembly on said movable support structure wherein said inductor assembly is reciprocally movable along said longitudinal axis; disengagable locking means for holding said inductor assembly stationary relative to said movable support structure, said locking means comprising: clamp means on said support structure having a generally stationary arm portion and a movable arm portion each arm portion having (i) a generally arcuate gripping portion concentric with said longitudinal axis and surrounding a circumferential portion of said carrier and (ii) a base portion extending from one end of said arcuate portion and having a bore extending therethrough aligned with a traverse axis generally perpendicular to said longitudinal axis; a spindle extending through said bore of each arm's base portion, said bore in said movable base portion sized a predetermined distance larger than said spindle to permit unrestrained, floating movement between said arcuate movable arm portion and said spindle, means for rotating said spindle about its axis; and means translating the rotational motion of said spindle to linear motion of said movable base arm portion along said traverse axis wherein rotation of said spindle means in one direction moves said movable arcuate arm portion towards said stationary arcuate base portion so that both arcuate portions frictionally engage said sleeve substantially about each portion's arcuate length to hold said carrier and thus said inductor assembly stationary with respect to said support structure.

2. An arrangement as defined in claim 1, wherein rotation of said spindle opposite said one direction positively moves said movable base arm portion away from said stationary base arm portion to disengage said clamp means from said inductor assembly.

3. An arrangement as defined in claim 2, wherein said spindle includes an elongated, helically threaded portion; said translating means is comprised of a sleeve member having internal threads matingly engaging the threaded portion of said spindle; and said arrangement includes means for preventing rotational movement of said sleeve relative to said spindle to effect linear motion along said traverse axis thereof.

4. An arrangement as defined in claim 3, wherein resilient biasing means are disposed between said movable arm base portion and said sleeve member.

5. An arrangement as defined in claim 4, wherein said carrier has an elongated generally cylindrical shape with a mid-portion of reduced cross-section, said mid-portion extending through said arm arcuate portions, a housing containing said carrier's mid-portion in an opening thereof, said biasing means disposed on opposite sides of said movable base arm portion.

6. An arrangement as defined in claim 3, wherein said biasing means are Bellville springs.

7. An arrangement as defined in claim 1, wherein said spindle is axially stationary with respect to said stationary arm base portion.

8. An arrangement as defined in claim 5, wherein each arcuate arm portion of said clamp means is positioned within said opening without contacting said housing.

9. An arrangement as defined in claim 1, wherein said clamp means is a generally P-shaped member, said arm arcuate portions are joined at their ends opposite their ends from which said base portions extend, said joined ends being notched to enhance said frictional engagement.

10. A mechanical arrangement for simultaneously locking in a fixed position a plurality of elongated, generally cylindrical assemblies, each of said assemblies being reciprocally movable along a linear path generally parallel to each other, said arrangement comprising: clamping means associated with each cylindrical assembly having movable and stationary arm portions, each arm portion having a generally arcuate gripping portion extending about one side of said cylindrical assembly, a base portion contiguous with and extending from one end of each arm's arcuate portion, said arcuate portions joined at their other ends; each base portion having a central bore extending therethrough along an axis generally perpendicular to and laterally offset from said path of said cylindrical assemblies, a spindle extending through said axis, said bore in said stationary base portion sized to prevent axial movement between said stationary base portion and said spindle, said bore in said movable base portion sized to permit lateral movement of said base portion relative to said spindle, translating means associated with said spindle to effect gradual movement of said arcuate arm portions toward each other for frictional engagement of each arcuate arm portion surface with said cylindrical assembly substantially about the arcuate length thereof when said spindle is rotated about said axis in a predetermined direction, said translating means positively separating said arcuate arm portions when said spindle means is rotated about said axis in an opposite direction; and means for selectively rotating each spindle to effect simultaneous, gradual, clamping and unclamping of each of said clamping means on its respective cylindrical member.

11. An arrangement as defined in claim 10 wherein spring means are inserted between each spindle and said movable base arm portion associated therewith for resisting movement of said base arm portion by said spindle; said means for selectively rotating each spindle including a reversible motor, and a rack and pinion arrangement connected to all spindles in said arrangement and mechanically driven by said reversible motor a distance sufficient to compress all of said spring means.

* * * * *